US005662013A

United States Patent [19]

Lin

[11] Patent Number: 5,662,013

[45] Date of Patent: Sep. 2, 1997

[54] COMPACT TOOL COMBINATION

[76] Inventor: Chiang-Her Lin, No. 22-8, Her Chuang Lane, Jiann Dong Road, Dah Li City Taichung County, Taiwan

[21] Appl. No.: 609,826

[22] Filed: Mar. 1, 1996

[51] Int. Cl.[6] ..... B25G 1/08

[52] U.S. Cl. ..... 81/490; 81/177.4

[58] Field of Search ..... 81/177.4, 437, 81/490

[56] References Cited

U.S. PATENT DOCUMENTS

| | | | |
|---|---|---|---|
| 4,278,119 | 7/1981 | Elmore | 81/490 |
| 4,960,016 | 10/1990 | Seals | 81/490 X |
| 5,265,504 | 11/1993 | Fruhm | 81/490 X |

*Primary Examiner*—James G. Smith

*Attorney, Agent, or Firm*—Charles E. Baxley, Esq.

[57] ABSTRACT

A tool includes a spring received in a handle. The handle has a number of protrusions and projections formed in one end. A slide is slidably engaged in the handle and engaged with the spring and has a number of cavities for engaging with a number of tool bits. The spring may bias the tool bits slightly outward of the handle. A block has a number of notches for engaging with the protrusions and has a number of depressions for engaging with the projections so as to secure the block to the handle. The block has a shaft for engaging with and for driving the tool bits. The slide and the tool bits may be safely received in the handle. The block has a bore for engaging with the shaft.

3 Claims, 6 Drawing Sheets

COMPACT TOOL COMBINATION

BACKGROUND OF THE INVENTION

1. Field of the Invention

The present invention relates to a tool, and more particularly to a compact tool combination.

2. Description of the Prior Art

Typical screw drivers comprise a handle having a shaft extended therefrom for engaging with a tool bit and for driving the tool bit for driving fastening screws. One type of the screw drivers comprises a number of tool bits that may be engaged with the shaft for driving various kinds of screws. However, normally, the tool bits may not be safely protected and will be easily lost.

The present invention has arisen to mitigate and/or obviate the afore-described disadvantages of the conventional tools.

SUMMARY OF THE INVENTION

The primary objective of the present invention is to provide a compact tool combination which includes a number of tool bits that may be safely protected within the handle.

In accordance with one aspect of the invention, there is provided a tool combination comprising a handle including a hollow interior and including an open top having a plurality of spaced protrusions extended upward therefrom, the handle including an upper portion having a projection means formed therein, a spring means engaged in the hollow interior of the handle, a slide slidably engaged in the handle and engaged with the spring means, the slide including a plurality of cavities formed therein for engaging with tool bits, the spring means biasing the slide toward the open top of the handle so as to move the tool bits slightly outward of the handle, the projection means being engaged with the slide so as to prevent the slide from disengaging from the handle, and a block including a middle portion having a plurality of ears extended radially outward therefrom so as to form a plurality of notches therebetween for engaging with the protrusions, the block including a depression means formed therein for engaging with the projection means so as to secure the block to the handle, the block including a shaft extended therefrom, the shaft including an engaging hole for engaging with and for driving the tool bits. The slide is depressed inward of the handle when the notches of the block are engaged with the protrusions of the handle and when the projection means is engaged with the depression means such that the tool hits may be safely received in the handle.

The block includes a bore formed therein for engaging with the shaft so as to allow the shaft to be received in the hollow interior of the handle.

The slide includes a tapered surface for engaging with the projection means and for allowing the slide to be partially extended outward of the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
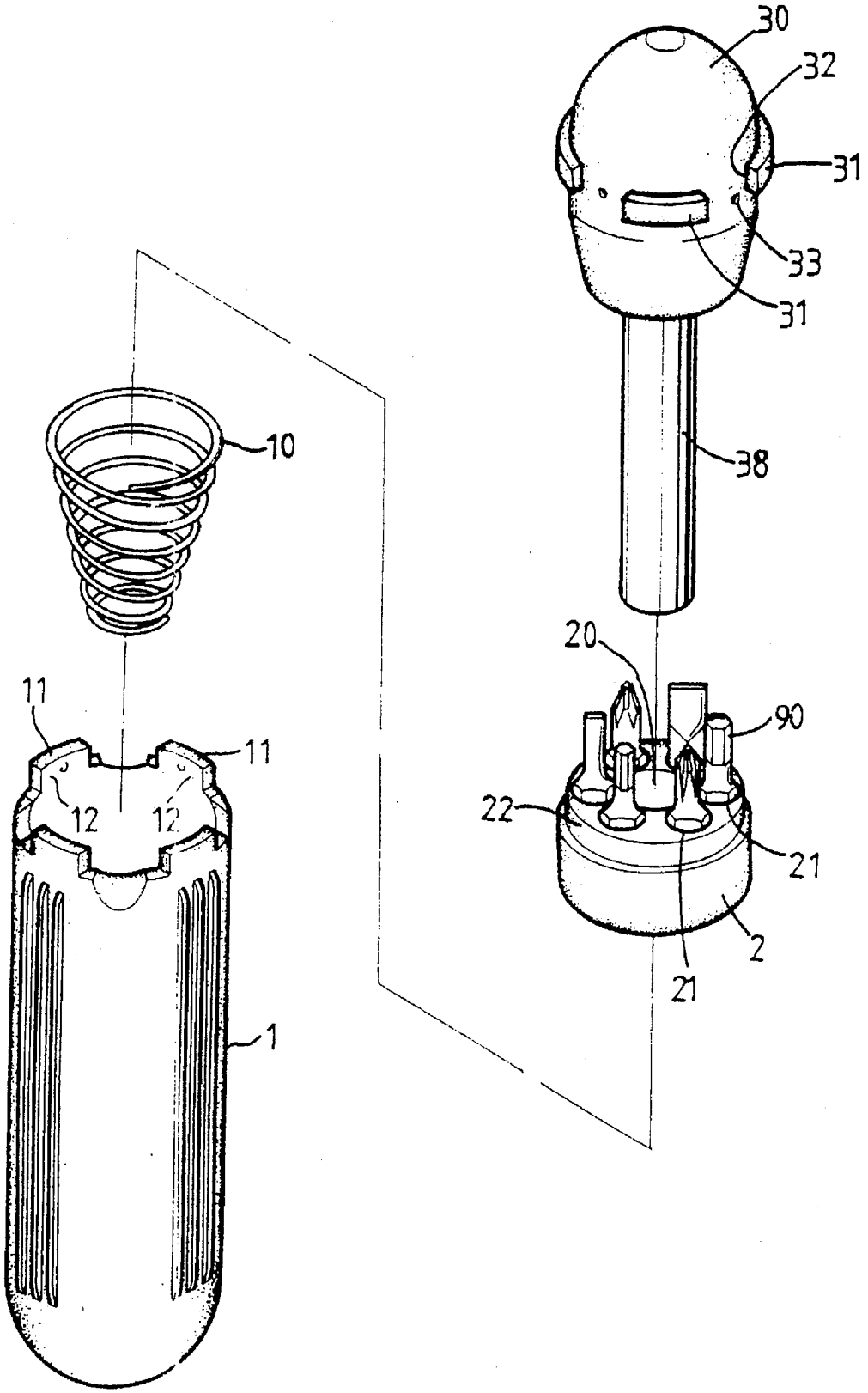
FIG. 1 is an exploded view of a compact tool combination in accordance with the present invention.
Figure 2:
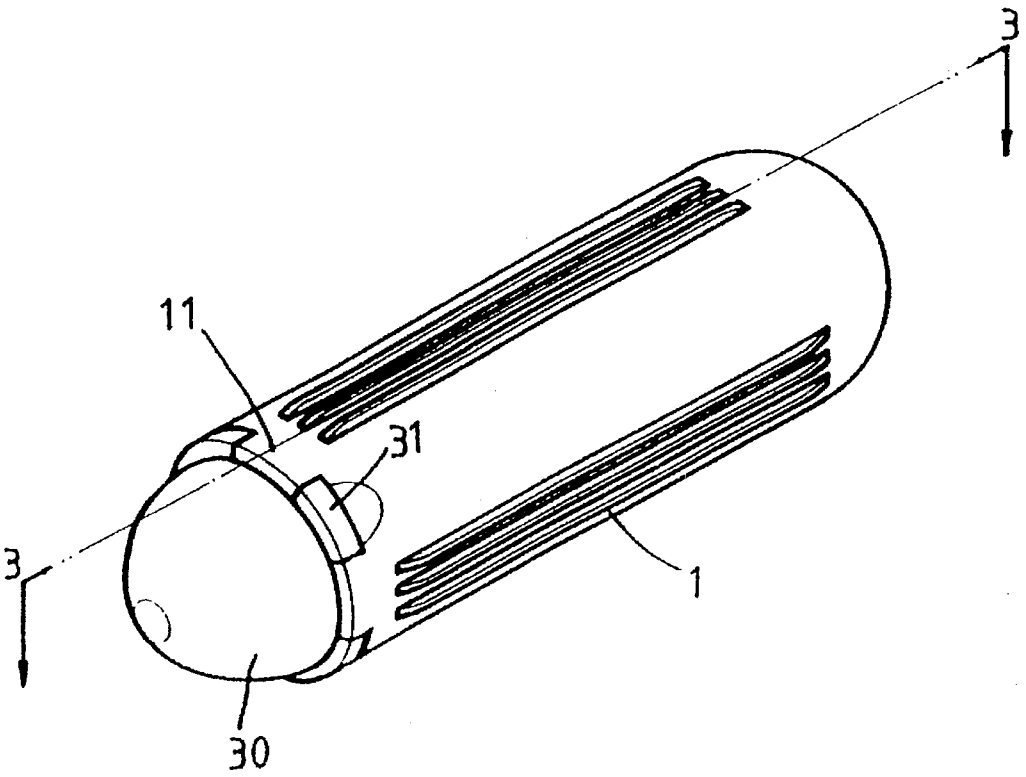
FIG. 2 is a perspective view of the compact tool combination.
Figure 3:
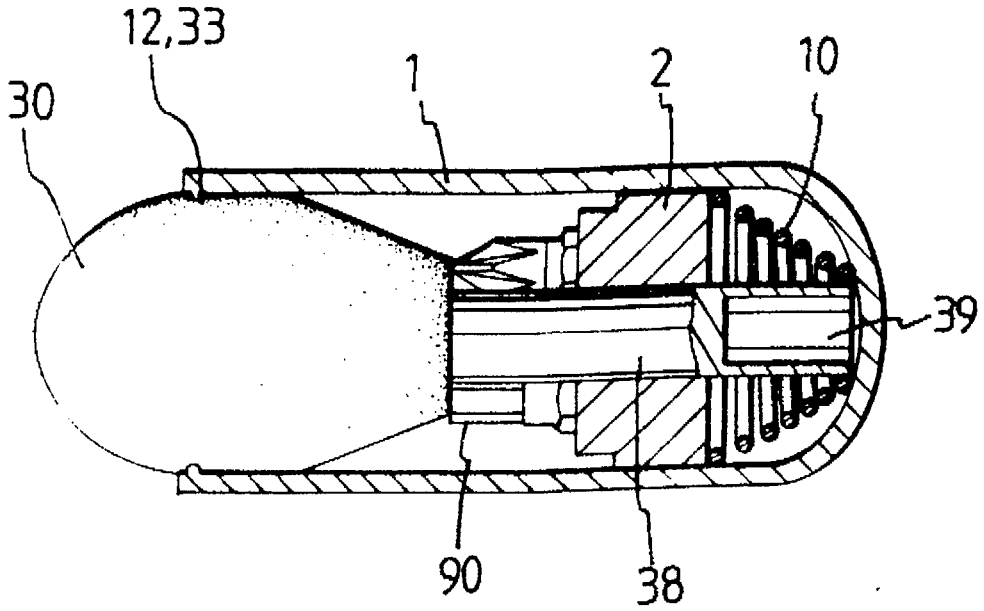
FIG. 3 is a cross sectional view taken along lines 3—3 of FIG. 2.

Referring FIGS. 1 to 3, a compact tool combination in accordance with the present invention comprises a handle 1 including a hollow interior for receiving a spring 10 therein and including an open top having a number of spaced protrusions 11 extended upward from the peripheral portion thereof. The protrusions 11 each includes a projection 12 extended radially inward of the handle 1.

A slide 2 is slidably engaged in the handle 1 and engaged with the spring 10. The slide 2 includes a bore 20 formed therein and includes a number of cavities 21 formed therein for engaging with a number of tool bits 90 respectively. It is preferable that the slide 2 is made of resilient material, such as rubber, in order that the tool bits 90 may be easily engaged and retained in the cavities 21 of the slide 2. The spring 10 may bias the slide 2 toward the open top of the handle 1 and may move the tool bits 90 slightly outward of the handle 1 (FIG. 4) such that the tool bits 90 may be disengaged from the slide 2. The projections 12 may be engaged with the slide 2 so as to prevent the slide 2 from disengaging from the handle 1. The slide 2 includes a cylindrical surface 22 for engaging with the projections 12 and for allowing the slide 2 to be partially extended outward of the handle 1.

A block 30 includes a number of ears 31 extended radially outward from the middle portion thereof so as to form a number of notches 32 therebetween for engaging with the protrusions 11. The block 30 includes a number of depressions 33 formed between the ears 31 for engaging with the projections 12 of the handle 1 such that the block 30 may be stably secured to the handle 1. The block 30 includes a shaft 38 extended from one end thereof. The shaft 38 includes an engaging hole 39 formed in the free end thereof for engaging with either of the tool bits 90.

As shown in FIGS. 2 and 3, the shaft 38 may be engaged in the handle 1 and may be engaged within the bore 20 of the slide 2 such that the shaft 38 and the slide 2 may all be received in the handle 1 so as to form a rather compact configuration.

Figure 4:
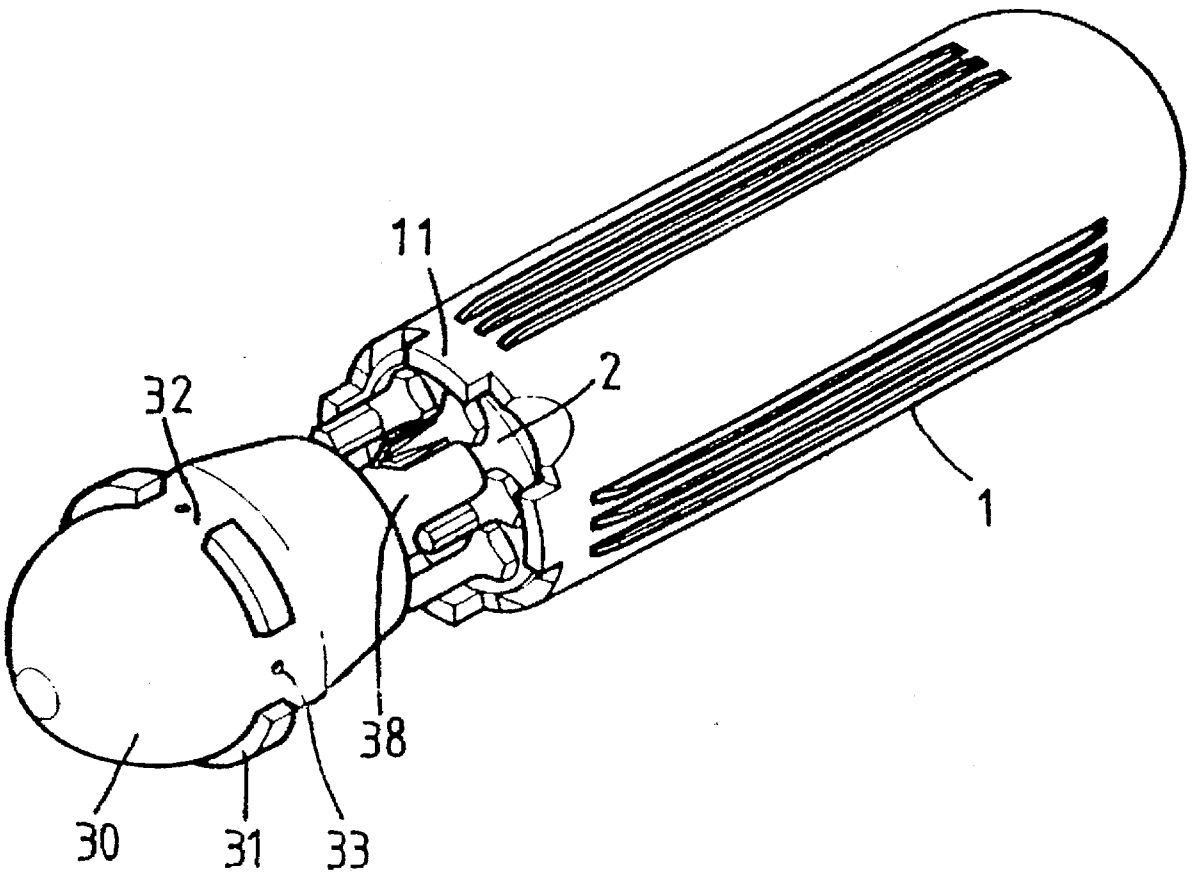
FIG. 4 is a partial exploded view of the compact tool combination.
Figure 5:
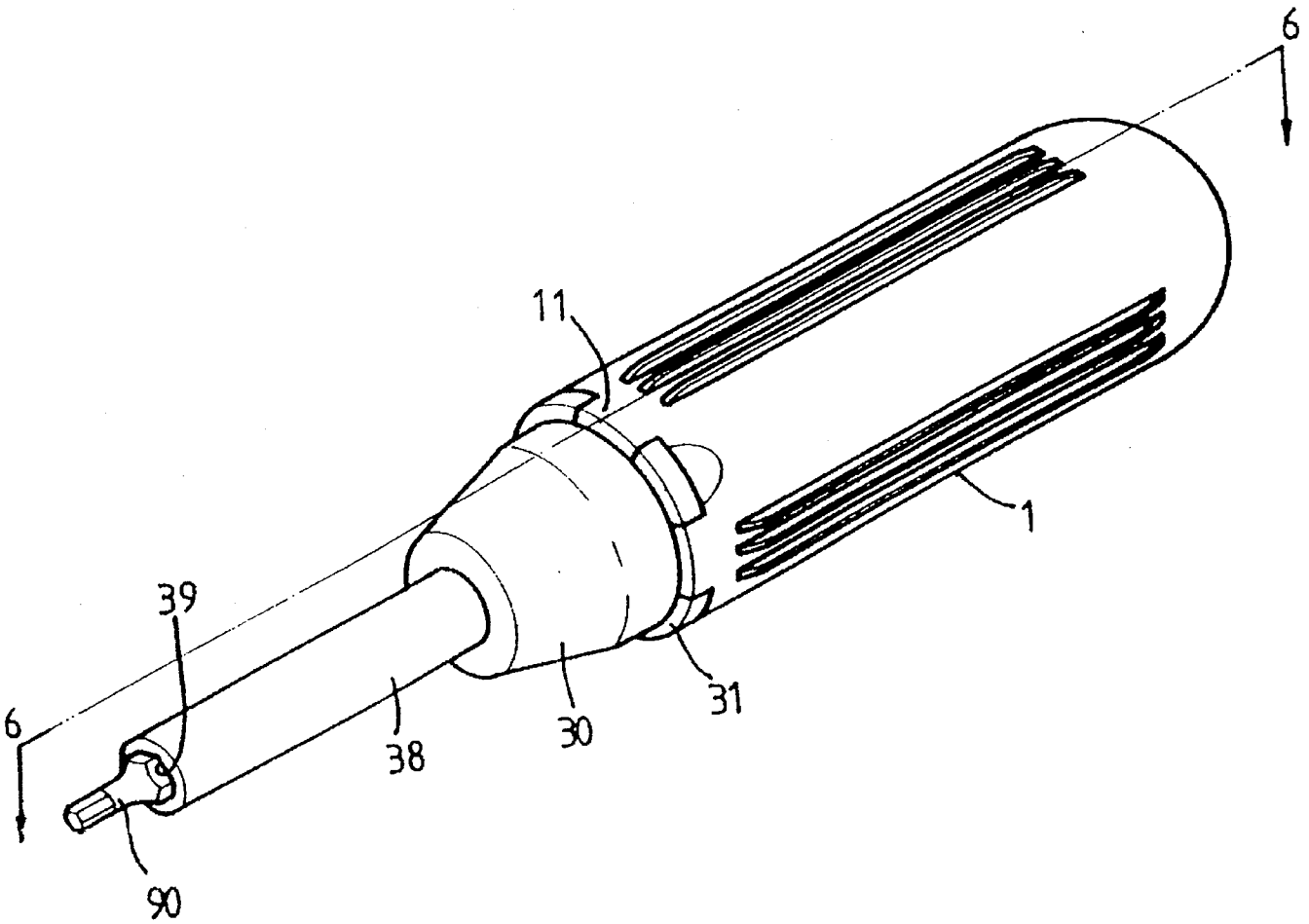
FIG. 5 is a perspective view illustrating the application compact tool combination.
Figure 6:
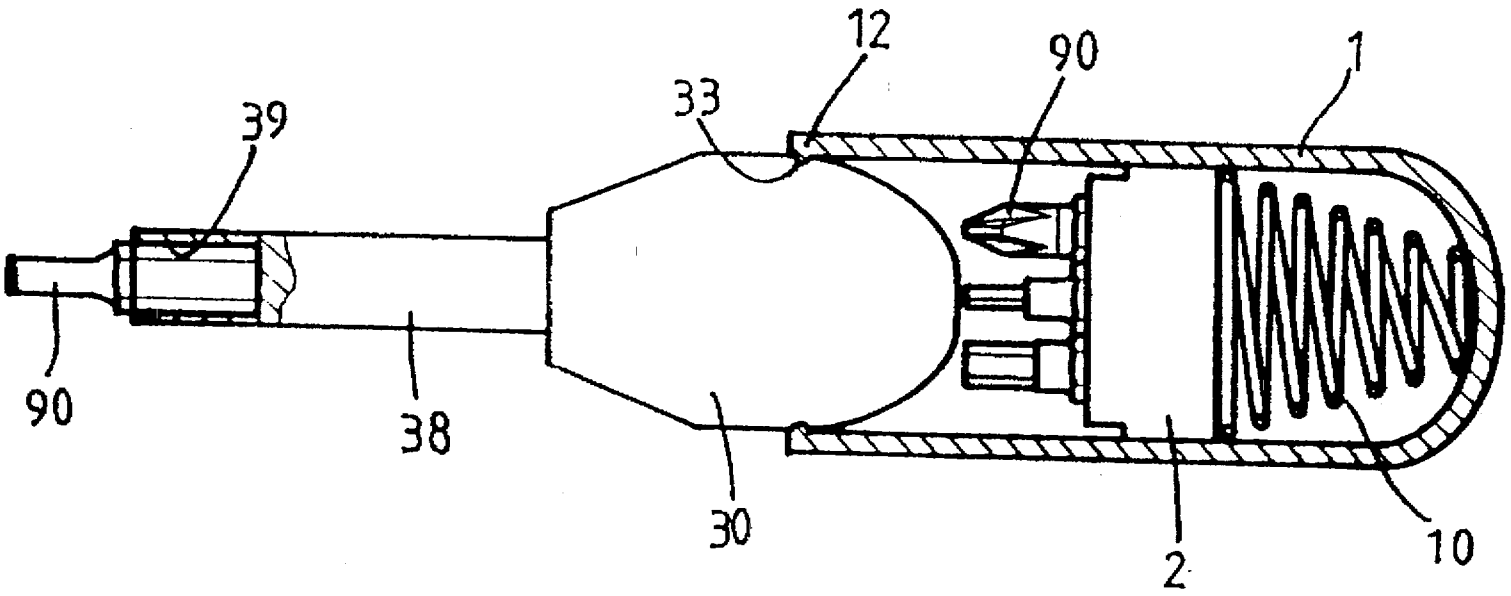
FIG. 6 is a cross sectional view taken along lines 6—6 of FIG. 5.

Referring next to FIGS. 4 to 6, the shaft 38 may be arranged outward of the handle 1 after disengaging from the handle 1. Either of the tool bits 90 may be disengaged from the slide 2 and may be engaged with the engaging hole 39 of the shaft 38. The shaft 38 and the block 30 may be effectively rotated by the handle 1 because of the engagement between the ears 31 of the block 30 and the protrusions 11 of the handle 1. The slide 2 may be pressed inward of the handle 1 by the block 30. The block 30 may be stably secured to the handle 1 by the engagement between the projections 12 of the handle 1 and the depressions 33 of the block 30. It is to be noted that the projections may be formed on the block 30 instead of forming in the handle, and the depressions 33 may he formed in the handle 1 instead of forming in the block 30 such that the block 30 may also be secured to the handle 1 by the engagement between the projections and the depressions.

Accordingly, the compact tool combination in accordance with the present invention includes a number of tool bits that may be safely protected within the handle. The shaft 38 may be received in the handle 1 so as to form a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a handle including a hollow interior and including an open top having a plurality of spaced protrusions extended upward therefrom, said handle including an upper portion having a projection means formed therein, a spring means engaged in said hollow interior of said handle, a slide slidably engaged in said handle and engaged with said spring means, said slide including a plurality of cavities formed therein for engaging with tool bits, said spring means biasing said slide toward said open top of said handle so as to move the tool bits slightly outward of said handle, said projection means being engaged with said slide so as to prevent said slide from disengaging from said handle, and a block including a middle portion having a plurality of ears extended radially outward therefrom so as to form a plurality of notches therebetween for engaging with said protrusions, said block including a depression means formed therein for engaging with said projection means so as to secure said block to said handle, said block including a shaft extended therefrom, said shaft including an engaging hole for engaging with and for driving the tool bits, said slide being depressed inward of said handle when said notches of said block are engaged with said protrusions of said handle and when said projection means is engaged with said depression means.

2. A tool combination according to claim 1, wherein said block includes a bore formed therein for engaging with said shaft so as to allow said shaft to be received in said hollow interior of said handle.

3. A tool combination according to claim 1, wherein said slide includes a cylindrical surface for engaging with said projection means and for allowing said slide to be partially extended outward of said handle.

* * * * *